United States Patent [19]

Pozniak et al.

[11] Patent Number: 4,831,976

[45] Date of Patent: May 23, 1989

[54] ENGINE WITH VALVE SEAT INSERTS AND METHOD OF RETAINING

[75] Inventors: Donald J. Pozniak, Utica; Leonardas Kutkus, Birmingham, both of Mich.

[73] Assignee: General Motors Corporation, Detroit, Mich.

[21] Appl. No.: 230,689

[22] Filed: Aug. 9, 1988

Related U.S. Application Data

[63] Continuation of Ser. No. 10,240, Feb. 2, 1987, abandoned.

[51] Int. Cl.[4] ..... F01L 3/22

[52] U.S. Cl. ..... 123/188 S

[58] Field of Search ..... 123/188 S

[56] References Cited

U.S. PATENT DOCUMENTS

| | | | |
|---|---|---|---|
| 1,733,696 | 10/1929 | Ricardo | 123/188 |
| 1,949,614 | 3/1934 | McDonald | 123/188 S |
| 2,017,154 | 10/1935 | Larkin | 123/188 S |
| 2,165,311 | 7/1939 | Stancliff | 123/188 S |
| 2,517,114 | 8/1950 | Karcher et al. | 123/188 S |
| 3,028,850 | 4/1962 | Gleeson | 123/188 S |
| 3,428,035 | 2/1969 | Stefan et al. | 123/188 S |
| 3,820,522 | 6/1974 | Scherenberg | 123/188 S |
| 3,868,953 | 3/1975 | Roll | 123/188 S |
| 4,217,875 | 8/1980 | Elsbett et al. | 123/188 S |
| 4,248,191 | 2/1981 | Albert | 123/188 S |
| 4,359,026 | 11/1982 | Holthausen et al. | 123/188 M |
| 4,462,343 | 7/1984 | Eckert | 123/41.69 |
| 4,543,925 | 10/1985 | Ruf | 123/188 S |

FOREIGN PATENT DOCUMENTS

| | | | |
|---|---|---|---|
| 3331145 | 3/1985 | Fed. Rep. of Germany | 123/188 S |
| 0224409 | 12/1984 | Japan | 123/188 S |

*Primary Examiner*—Willis R. Wolfe
*Assistant Examiner*—M. Macy
*Attorney, Agent, or Firm*—Robert J. Outland

[57] ABSTRACT

A valve seat insert of relatively hard (e.g. ferrous) material is positively retained in a recess around a gas flow port in the relatively softer (e.g. aluminum) wall of an engine combustion chamber by deforming a portion of the wall material against a chamfer provided at the outer edge of the insert. The deformation may be accomplished by machining or rolling the proud edge of the wall recess against the chamfer. The port flow may be improved by machining a shallow dished area about the valve seat at the end of the insert and the adjacent wall and the machining step may be used to also deform the wall material against the chamfer or it may follow the deforming step.

3 Claims, 1 Drawing Sheet

ENGINE WITH VALVE SEAT INSERTS AND METHOD OF RETAINING

CROSS REFERENCE

This is a continuation of U.S. patent application Ser. No. 010,240 filed Feb. 2, 1987 and now abandoned.

TECHNICAL FIELD

This invention relates to valve seat inserts for and in combination with internal combustion engines and other machines having poppet valve controlled combustion or working chambers. The invention further relates to methods of retaining seat inserts in their associated engine or machine components.

BACKGROUND

It is known in the art relating to internal combustion engines, especially where the cylinder heads or valve bodies are formed of aluminum or other relatively soft material, to provide separate valve seat inserts of a harder material, such as iron or steel. These form long wearing and serviceable seats for engagement by poppet valves in controlling access to the associated engine cylinders.

In order to retain such an insert in place, the cylinder head, cylinder block or other valve body, is generally provided with a cylindrical recess into which the harder insert is shrink, or press, fitted or a combination of both. To assure retention, the insert is generally shorter than the recess so that a portion of the recess wall extends beyond the insert. This portion is not subject to the direct stresses of the press or shrink fitting and, thus, remains unexpanded, thereby acting to positively retain the insert in its installed position.

We have found, however, that the stepped configuration of the insert and the adjacent protruding portion of the recess forms an impediment to gas flow through the open valve, which it is desired to avoid.

SUMMARY OF THE INVENTION

The present invention provides an improved design of valve seat insert. The improved insert is adapted to be retained positively in a recess surrounding a gas flow port in the relatively softer wall of an engine combustion chamber by deforming a portion of the wall material against a chamfer provided at the outer edge of the insert. The deformation may be accomplished by machining or rolling the proud edge of the wall recess against the chamfer.

The invention also provides improved gas flow through the open valve by machining a shallow dished area about the valve seat at the end of the insert and in the adjacent wall. If desired, the machining step may also be used to deform the wall material against the chamfer or the machining step may follow a separate deforming step.

Preferably the relative angles of the chamfer, the valve seat and the dished area relative to the axis of the valve seat insert, or a plane normal thereto, are selected to provide ease of assembly and adequate retention of the insert, suitable sealing of the poppet valves and a maximum capability of flow through the port with the valve in the open position.

These and other features and advantages of the invention will be more fully understood from the following description of a preferred embodiment of the invention taken together with the accompanying drawings.

BRIEF DRAWING DESCRIPTION

DETAILED DESCRIPTION

Figure 1:
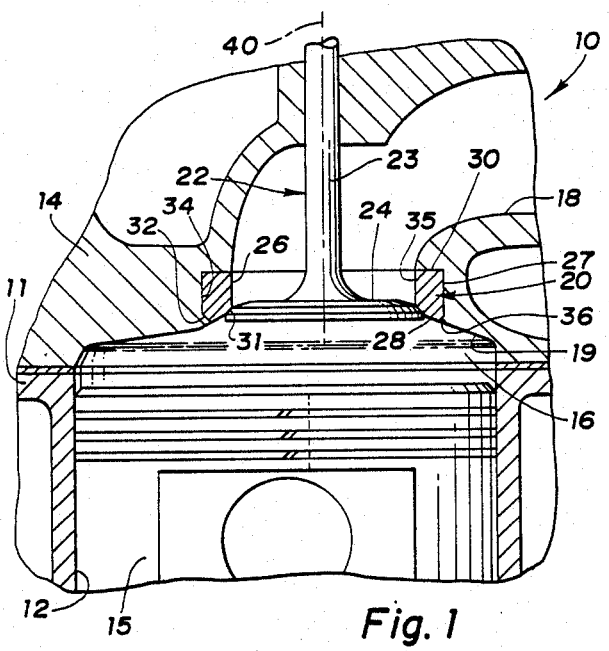
FIG. 1 is a fragmentary cross-sectional view through a portion of one of the cylinders of an internal combustion engine illustrating one of the cylinder head ports and its poppet valve seating against a valve seat insert mounted therein.

Referring now to the drawings in detail, numeral 10 generally indicates an internal combustion engine having the usual cylinder block 11 defining a plurality of cylinders 12, only one of which is shown. A cylinder head 14, mounted on the top of the cylinder block and closing the ends of the cylinders, cooperates with pistons 15, one of each in the cylinders, to define variable volume working or combustion chambers 16 at the cylinder ends.

Access to the engine combustion chambers is through intake and exhaust ports, of which only a single port 18, representing the intake and exhaust ports of the engine, is illustrated. Port 18 extends through the cylinder head, opening to the combustion chamber at an inner wall 19 through a valve seat insert 20 carried in the wall 19. A poppet valve 22 for each port includes a stem 23 reciprocable in the cylinder head and a valve head 24 carried by the stem and seatable against the valve seat insert to control access through the port 18 to or from the engine cylinder and its combustion chamber 16.

Figure 2:
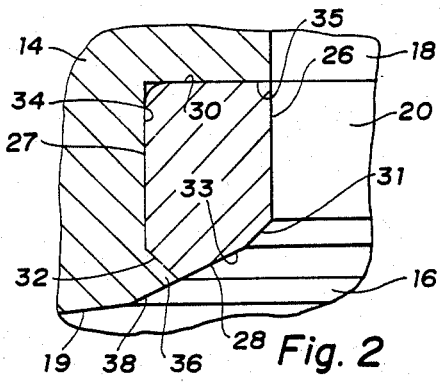
FIG. 2 is an enlarged cross-sectional view of a portion of FIG. 1 with the valve omitted showing the installed valve seat insert and adjacent area.

As is best shown in FIG. 2, the installed valve seat insert 20 comprises a hard metal ring, usually of ferrous material. The seat insert 20 has a generally cylindrical port-defining inner side 26 concentrically spaced within an outer side 27 formed as a right circular cylinder. The seat insert 20 further includes a seat end 28 including portions to be further described and a generally planar end 30 opposite the seat end. The seat end includes an angled valve seat 31 at its inner edge and an oppositely angled annular chamfer 32 at its outer edge. Intermediate the valve seat 31 and the chamfer 32, the seat end includes an annular center portion 33 to be subsequently more fully described.

The valve seat insert 20 is retained in an annular recess formed in the cylinder head at the combustion chamber end of the port 18 and comprising a cylindrical outer wall 34 adjoining a planar end wall 35. The outer wall 34 includes an inwardly protruding portion 36 that extends under and in engagement with the chamfer 32 at the outer edge of the seat insert to positively retain the insert 20 within the recess.

In the installed condition as shown in FIG. 2, the center portion 33 of the insert's seat end 28 and an annular surrounding portion 38 of the combustion chamber wall are machined at a shallow angle to form a smooth sided outwardly dished portion surrounding the valve seat 31 which improves the flow of gas entering or leaving the cylinder through the port 18 when the valve 22 is opened.

For reference purposes it is noted that the valve seat 31 formed on the insert 20 is centered on an axis 40. When the insert 20 is installed, the axis 40 is also the reciprocating axis of the poppet valve 22 and the axis on which the cylindrical outer wall 34 of the valve seat recess is also centered.

In reference to any hypothetical plane normal to the axis 40, the chamfer 32 preferably forms an angle of about 45° longitudinally away and radially outward from the extreme seat end of the insert whereas the valve seat 31 preferably forms a 45° angle away and radially inward from extreme end. These angles may, however, vary within reasonable limits. Thus, the chamfer angle could fall within the range of from 15° to 75° relative to the normal plane while the valve seat angle preferably lies within the range of from 40° to 50° from the normal plane.

As to the angle of the dished end portion 33, 38, we have found that for ideal gas flow conditions, particularly for an inlet valve having a 45° valve seat, the maximum flow conditions are obtained when the dished portion is disposed at an angle of between about 30° to 35° longitudinally away from the extreme end and radially inward toward the port from a reference plane, not shown, normal to the axis 40. It is recognized, however, that varying conditions of engine combustion chamber and valve construction may dictate some departure from the ideal range indicated while still providing or approximating the improved flow conditions of the present invention.

Figure 3:
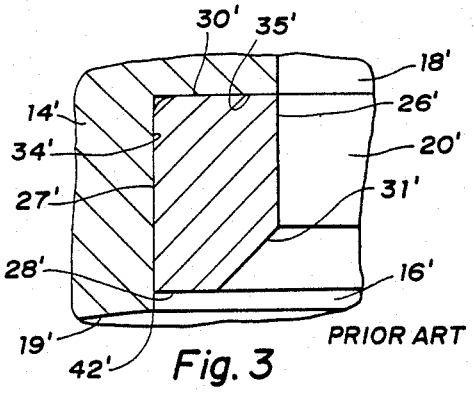
FIG. 3 is a cross-sectional view similar to FIG. 2 but illustrating the installed appearance of a prior art valve seat insert.

Referring now to FIG. 3, there is shown a comparable prior art valve seat installation in an engine cylinder head wherein primed numerals are utilized for modified parts. The arrangement of FIG. 3 differs from that of the present invention in that the valve seat insert omits the chamfer 32 at the seat end 28' and the dished configuration of the center portion 33'. Instead the portion outward of the valve seat 31' extends in planar fashion to the outer side 27' of the seat insert.

Also, the cylindrical wall 34' of the cylinder head recess extends beyond the seat end 28', forming a protrusion or proud corner 42' that extends below the valve seat insert. This stepped configuration constitutes an impediment to smooth flow of gases both into or out of the cylinder through the annular opening leading to the port when the valve is open. The stepped construction is avoided by the present invention as is seen in FIG. 2.

Figure 4:
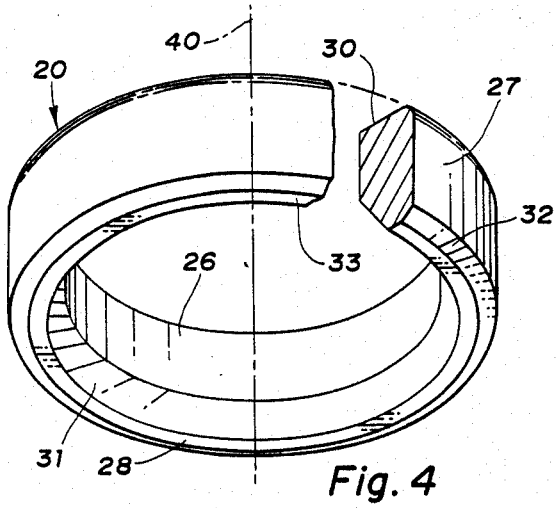
FIG. 4 is a pictorial view of a valve seat insert according to the invention prior to installation in an engine.
Figure 5:
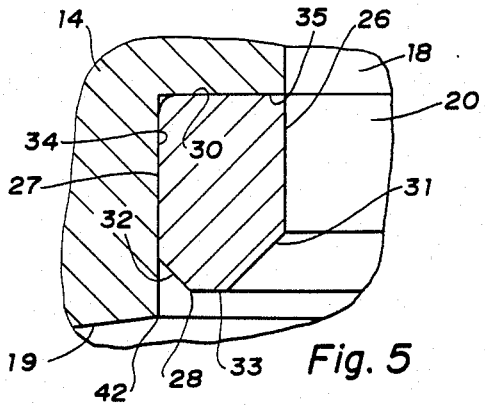
FIG. 5 is a cross-sectional view, similar to FIGS. 2 and 3, illustrating one step in the installation in an engine cylinder head of a valve seat insert according to the invention.

In the manufacture of an engine having valve seat inserts installed according to the invention, it is first necessary to form the required number of inserts as shown in FIG. 4. In this pictorial view, it is seen that the center portion 33 at the seat end of the insert is initially formed as a planar surface normal to the axis 40 and adjoining on opposite sides the chamfer 32 and the valve seat 31. Subsequently, the insert 20 is pressed into the cylinder head recess engaging the walls 34 and 35 as shown in FIG. 5. Note that the center portion 33 of the valve insert seat end is recessed from the proud edge 42 of the recess.

Figure 6:
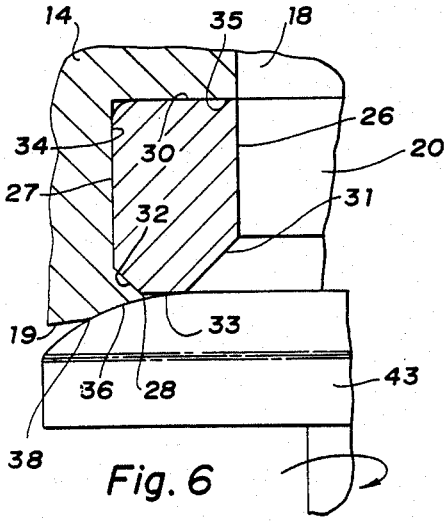
FIG. 6 is a cross-sectional view illustrating a method of metal deforming as a secondary step in the installation of a valve seat insert according to the invention.
Figure 7:
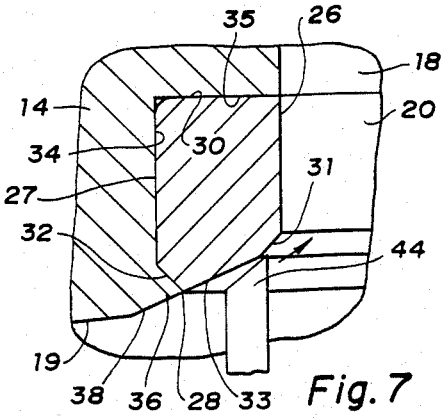
FIG. 7 is a cross-sectional view illustrating the final step of machining a flow improving dished area around the valve seat in accordance with the invention.

Thereafter, the pressed in insert 20 is locked into position by deforming the soft, normally aluminum, metal of the cylinder head by rolling or machining the proud edge 42 so as to force it inwardly into engagement with the chamfer 32. This forms the protruding portion 36 as shown in FIGS. 2, 6 and 7. FIG. 6, illustrates the deformation of the proud edge by rolling the edge 42 of the recess with a rolling tool 43, after which the center portion 33 of the seat insert and the surrounding portion 38 of the cylinder head are machined to form the angled dished portion previously described. The machining may be accomplished by any suitable cutting device 44 as shown, for example, in FIG. 7.

Alternatively, it may be possible to eliminate the rolling step illustrated in FIG. 6 and combine the deforming and cutting steps into a single step performed in the manner and with a cutting device of the form 44 shown in FIG. 7.

It should be apparent that, in the use of a valve seat insert according to the present invention, the addition of the chamfer 32 at the outer edge of the seat end and the subsequent deformation of cylinder head metal against the chamfer, substantially improves the retention conditions for the valve seat insert over the prior art arrangement which relies upon press or shrink fitting of the insert within the cylinder head recess. Additionally, the machining of the shallow dished surface surrounding the valve seat after installation provides improved gas flow characteristics for an additional benefit from the arrangement of the present invention.

While the invention has been described by reference to preferred embodiments, it should be understood that numerous changes could be made within the spirit and scope of the inventive concepts described. Accordingly it is intended that the invention not be limited to the described embodiments, but that it have the full scope permitted by the language of the following claims.

The embodiments of the invention in which an exclusive property or privilege is claimed are defined as follows:

1. A combination in an internal combustion engine of means defining a combustion chamber having an inner wall, said wall having an annular recess with a cylindrical wall around the port at its juncture with said chamber, a valve seat insert retained in said recess, said insert comprising a hard metal ring having an outer side received in and engaging the recess cylindrical wall and a seat end facing the combustion chamber and including an annular valve seat at its inner edge said valve seat being centered on an axis, and an outer portion of said seat end and an adjacent portion of the combustion chamber wall together forming an outwardly dished portion extending longitudinally and radially inwardly relative to the extreme end of the port opening at an angle in the range of from 20° to 35° from a plane normal to the valve seat axis said valve seat extending further inwardly from said dished portion at an angle in the range of from 40° to 50° from said normal plane.

2. A combination in an internal combustion engine of means defining a combustion chamber having an inner wall, a fluid conducting port opening to said chamber through said wall and having an annular recess with a cylindrical wall around the port at its junction with said chamber, a valve seat insert retained in said recess, said insert comprising a hard metal ring having an outer side received in and engaging the recess cylindrical wall and a seat end facing the combustion chamber and including an annular valve seat at its inner edge and an annular chamfer at its outer edge, said valve seat being centered on an axis, and a center portion of said seat end and an adjacent portion of the combustion chamber wall together forming an outwardly dished portion extending longitudinally and radially inward relative to the extreme end of the port opening at an angle in the range of from 20° to 35° from a plane normal to the valve seat axis, said valve seat extending further inwardly from said dished portion at an angle in the range of from 40° to 50° from said normal plane and the cylindrical wall having an inwardly protruding portion engaging at least part of said seat insert chamfer to positively retain the seat insert in the recess.

3. A combination as in claim 2 wherein said protruding portion engages substantially the entire extent of said seat insert chamber.

* * * * *